United States Patent [19]

Baldini et al.

[11] Patent Number: 4,656,813

[45] Date of Patent: Apr. 14, 1987

[54] SYSTEM AND EQUIPMENT FOR THE MANUFACTURE AND FILLING OF FLEXIBLE STERILIZABLE BAGS

[75] Inventors: Luciano Baldini, Tirano, Italy; Alberto Siccardi, Lugano, Switzerland

[73] Assignee: Bieffe S.p.A., Italy

[21] Appl. No.: 669,004

[22] Filed: Nov. 7, 1984

[30] Foreign Application Priority Data

Nov. 14, 1983 [IT] Italy ..... 23694 A/83

[51] Int. Cl.[4] ..... B65B 61/00

[52] U.S. Cl. ..... 53/410; 53/128; 53/167; 53/426; 53/451; 53/551

[58] Field of Search ..... 53/167, 425, 426, 433, 53/451, 511, 575, 128, 410, 551; 493/213

[56] References Cited

U.S. PATENT DOCUMENTS

| | | | |
|---|---|---|---|
| 2,917,883 | 12/1959 | Rock | 53/167 X |
| 3,579,945 | 5/1971 | Buchner er al. | 53/511 |
| 3,846,569 | 11/1974 | Kaplan | 53/555 X |
| 3,874,144 | 4/1975 | Feigel | 53/538 X |
| 4,109,792 | 8/1978 | Greenawalt | 53/452 X |
| 4,166,412 | 9/1979 | Versteege | 493/213 X |
| 4,326,574 | 4/1982 | Pallaroni et al. | 206/603 X |
| 4,387,547 | 6/1983 | Reil | 53/551 X |
| 4,494,357 | 1/1985 | Di Geronimo | 53/426 X |

FOREIGN PATENT DOCUMENTS 0008390 1/1977 Japan ..... 53/511

*Primary Examiner*—John Sipos
*Assistant Examiner*—Steven P. Weihrouch
*Attorney, Agent, or Firm*—Ostrolenk, Faber, Gerb & Soffen

[57] ABSTRACT

A method and apparatus for producing and filling sterilized bags includes the steps of: feeding a film material from which the bags are formed from at least one reel; printing information on the film; cleaning the film in two stages which includes ultrasonic vibration and washing with water; drying the film; sterilizing it with ultraviolet rays; applying valves to the film; welding, punching and printing the film to generate a large bag; filling the large bag with liquid and inert gas; applying a second welding orthogonal to the first welding direction to divide the larger bag into a plurality of final bag having a predetermined size; cutting the film into the individual bags and testing the integrity of each bag; and vacuum packaging the bags and/or megablistering it. The foregoing process steps can be realized with an apparatus which includes at least a film unwinding unit having a braking device; at least one ultrasonic washing tank and at least one tank with water nozzles which is fed from a recycling plant which supplies distilled water; a film alignment device which is positioned ahead of a folding prism which is used for folding the film; and a double filling pipe and a test band which operates in synchronism with a transport roller.

9 Claims, 8 Drawing Figures

SYSTEM AND EQUIPMENT FOR THE MANUFACTURE AND FILLING OF FLEXIBLE STERILIZABLE BAGS

1. FIELD OF THE INVENTION

The present invention relates to a system for the manufacture of bags of flexible material. Each bag is provided with at least a valve and the bag is filled with a material, in particular a perfusional solution or the like.

2. STATEMENT OF THE PRIOR ART

Many systems for forming flexible bags and filling them with liquid are well-known. In particular, U.S. Pat. No. 4,326,574 assigned to the Assignee of the present application, describes a process in which the plastic film from which the bag is produced is: unwound from a reel; washed in a tank holding a solution of polyphosphate in ionized water; pressed between rubber rollers; dried and treated with ultraviolet rays in a drying-sterilizing chamber; folded, supplied with a valve, welded first in the longitudinal direction, filled with liquid; welded in transverse direction; and is then cut to form final bags of a given size and shape.

This system has certain advantages, but with the advantages some practical drawbacks remain.

Continuing its research in the field, the Assignee has developed a system that attains excellent results and improvements in productivity, quality and safety and testing and realizes a drastic reduction in material wastage, energy consumption, all with a small system.

SUMMARY OF THE INVENTION

The system according to the invention is characterized in that the film from which the bags are formed is unwound from a reel and has a width which is an integer number multiple of the size of the final bag. Information is printed on the film after which the film passes over shock abosrbing winding rollers and then is washed in two stages. The first washing stage is with ultra-sound, and the second stage is carried out with water jets. Then the film is dried, punched and sterilized by means of UV-rays, and plied at 270°. After descending through the action of a transport, it undergoes the phases of welding, filling and application of valves and stamping. The stamped bags are filled and then subdivided by means of a welding process into smaller bags. The smaller bags are then collected and tested after which they undergo either a partial stiffening of one of their bands or a packaging preferably under vacuum into an external envelope.

Further, the invention includes a machine having a feeding station including a film unwinding unit supplied with a braking device that controls the washed film tension; a washing unit including at least an ultrasonic wash tank and at least a washing tank with water jets, which is supplied with distilled water from a closed circuit filtering and recycling unit; a treatment station including drying and winding rollers, a film alignment device that precedes a folding prism at 270°, which insures that film is folded with precision; a forming and filling unit including a double filling pipe for feeding solution into the various bags and means for replacing the air in the bag with inert gas during the final closing phase of the bag; and a test station by means of which the final bags are submitted to an integrity test by means of a conveyor moving in synchronism with the main conveyor to thereby apply an adjustable pressure to the bags during their passage.

BRIEF SUMMARY OF THE DRAWINGS

The various features and advantages of the present invention are described by way of non-limiting embodiments with reference to the drawings, in which.

DESCRIPTION OF THE PREFERRED EMBODIMENTS

Figure 1:
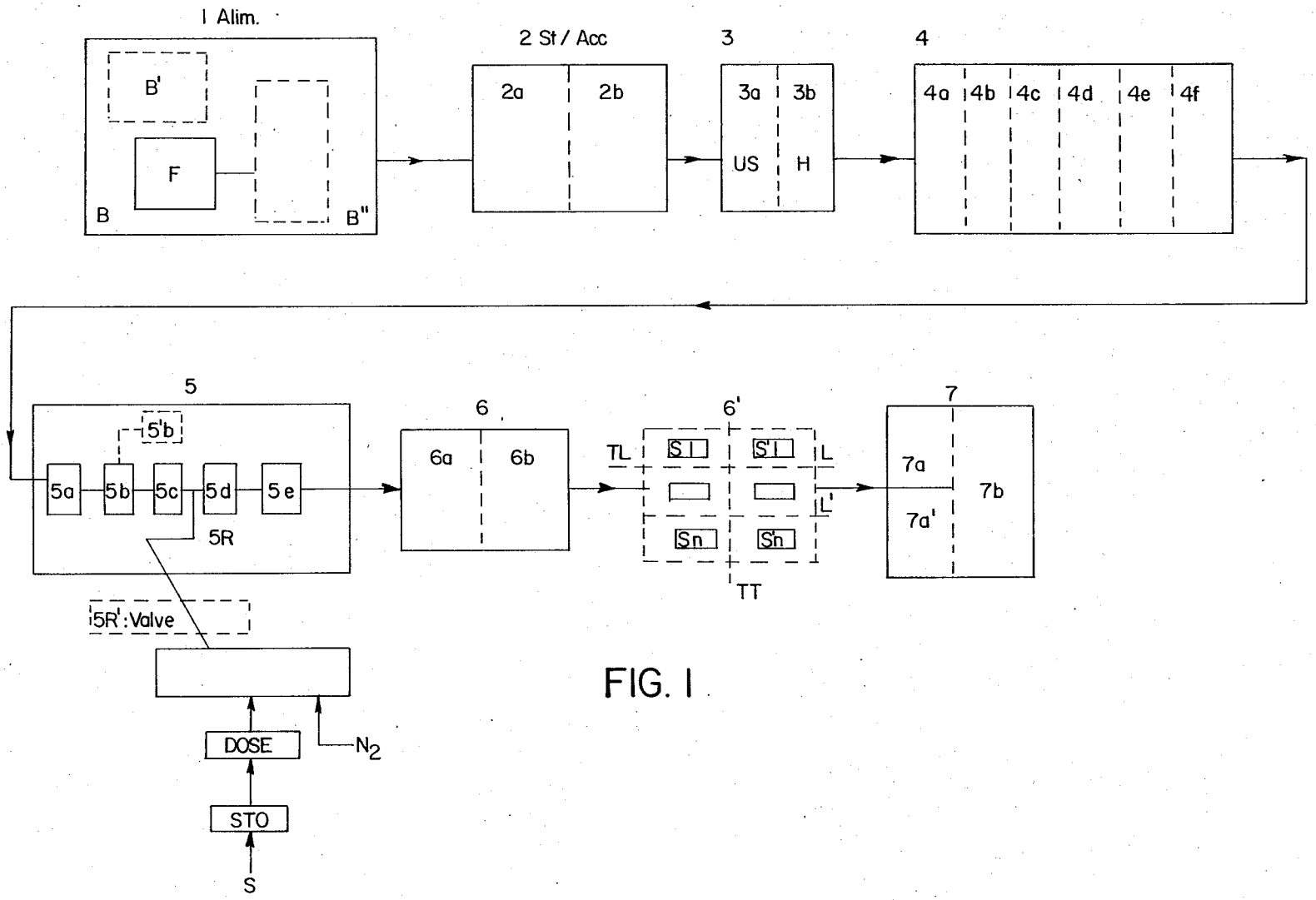
FIG. 1 is a block diagram of the process of the present invention.
Figures 2, 2A:
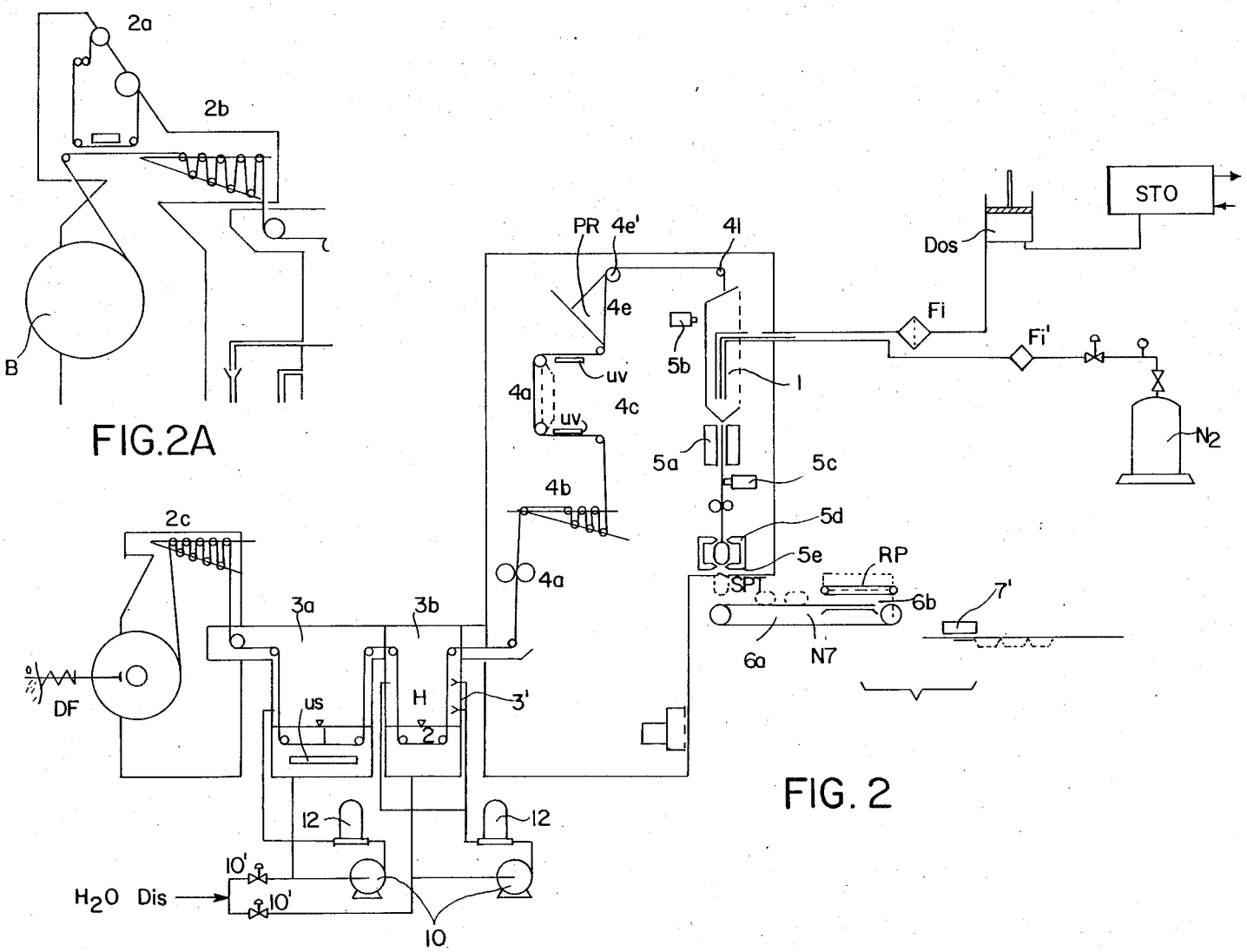
FIG. 2 is a kinematic illustration of the process of FIG. 1.
FIG. 2A is an additional variant of the scheme shown in FIG. 2.
Figure 3:
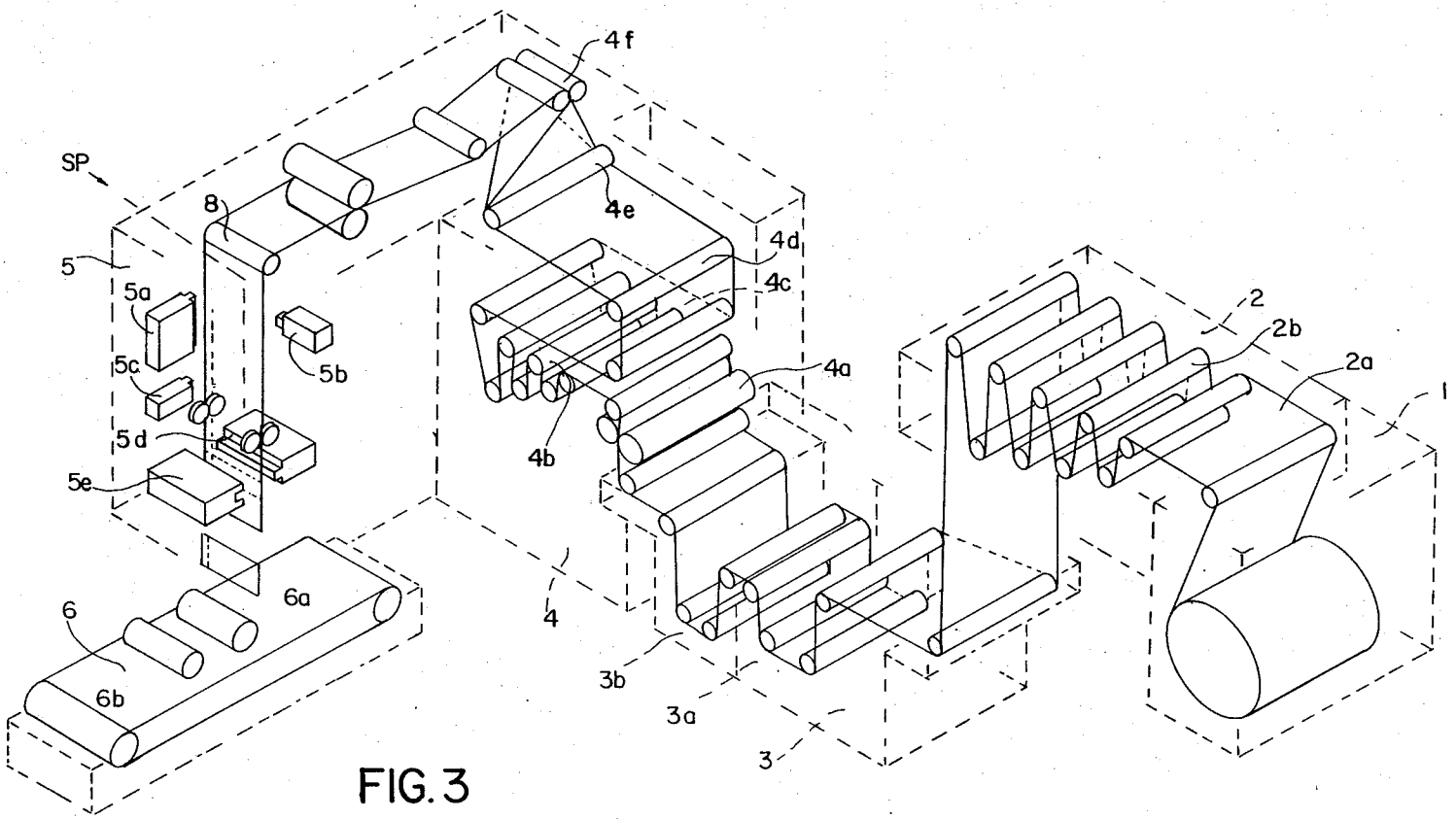
FIG. 3 is a schematic, partially in axonometric view, which shows a preferred layout of the stages and means for carrying out the process according to FIG. 1.

Referring to FIGS. 1, 2 and 3, the system according to the invention substantially includes at least 5 stations each of which carries out one or more steps of the present invention. In particular, block 1 shows the step and apparatus, namely the film feeding unit F, drawn from a reel B; the dashed rectangles illustrate the possibility of installing at least a second reel B′ in the unit 1 parallel to the first reel B which has the same width as the other reel, or a reel B″ having a width equal to n times the width of B or B′. The unwinding reel is coupled to a tension adjusting device including a braking mechanism DF. Block 2 shows the step and apparatus, namely the print unit (2*a*) and the winding unit (2*b*), for the film F coming from the reel B and/or B′ or B″. The block 3 shows the step and corresponding apparatus for the washing sequence which, according to an important feature of the invention, consists of two separated stages 3*a* and 3*b* in which the film F is submitted to an ultrasonic cleaning with unit US (3*a*) and a washing (3*b*) with distilled water injected by nozzles 3′ fed by pumps 10 and filters 12. Each pump 10 is connected to a distilled water source by valves or cocks 10′ (FIG. 2). Preferably, the feeding of the distilled water is a closed circuit type device which includes the means for partial liquid recycling. When more reels B, B′, etc., having the same width, or a reel B″ having a width n times that of the other reels are used, the units 2 and 3 are suitable for operating simultaneously on the whole film. Block 4 shows the film treatment phase which is divided into subphases that include: the drying (4*a*); the winding (4*b*); the sterilization by ultraviolets UV (4*c*); the alignment (4*d*); the folding (4*e*); and the transport device (4*f*).

FIGS. 2 and 3 show the respective devices for realizing the foregoing method steps. These include several squeezing rollers 4*a*, a conventional series of winding rollers 4*b*, a UV lamp joined with rollers 4*c*, alignment rollers 4*d*, a folding prism PR located between the rollers 4*e* and a tension roller 4*f* cooperating with the second folding roller 4′*e*.

Figure 5:
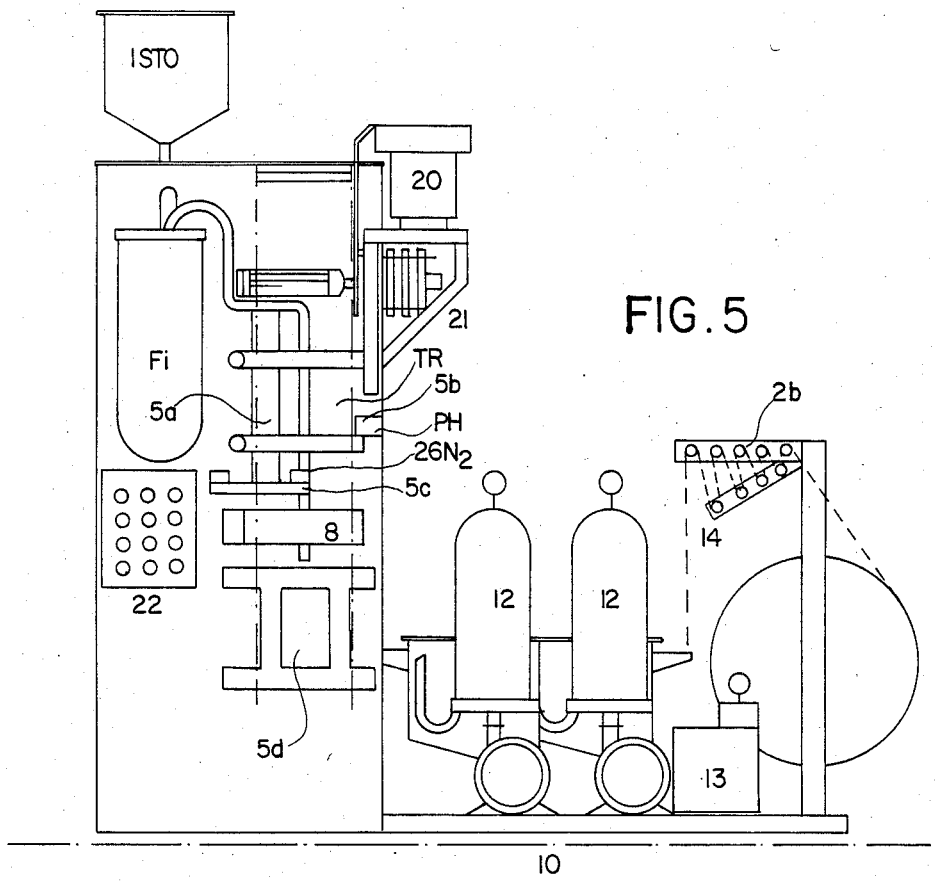
FIGS. 5, 6, and 7 are front (schematic and partial) views of the machine of FIG. 4, respectively, in the directions of arrows X, Y and Z of FIG. 4.
Figure 4:
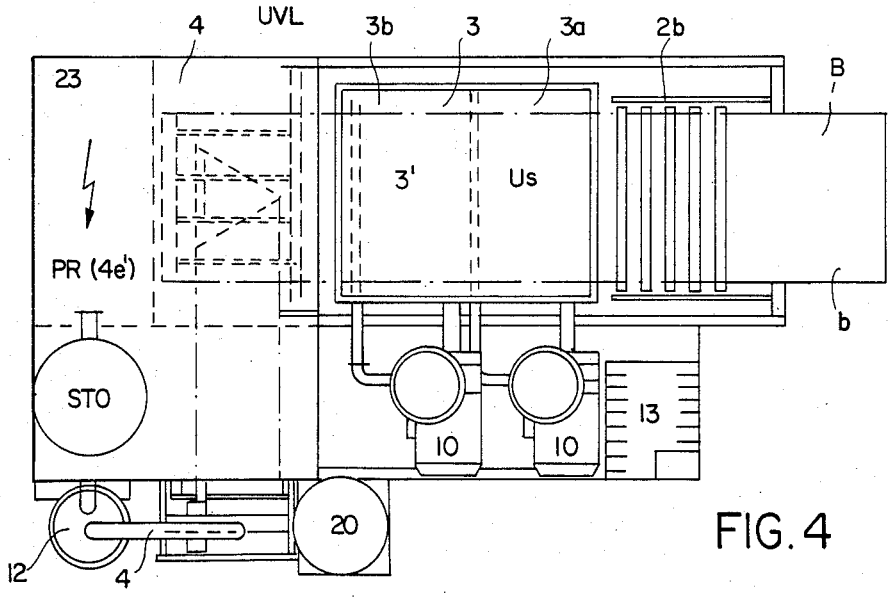
FIG. 4 is a plan view of a preferred apparatus which is usable for carrying out the process according to the schemes of FIGS. 1 and 2A and including the elements of FIG. 2.
Figure 7:
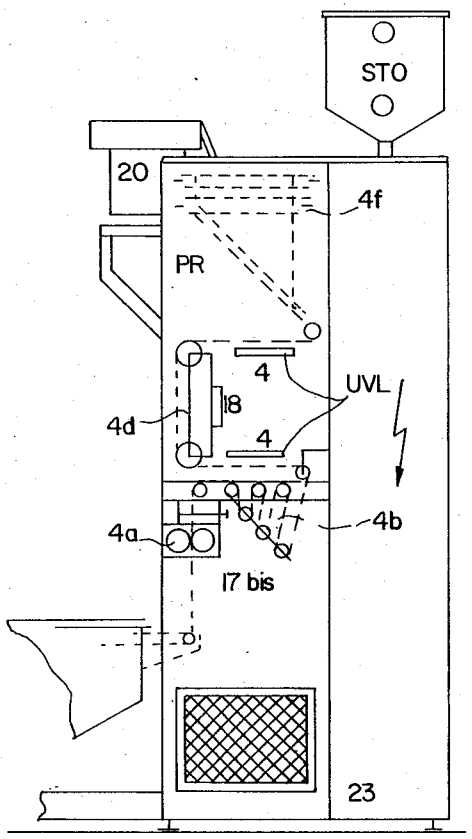
Figure 6:
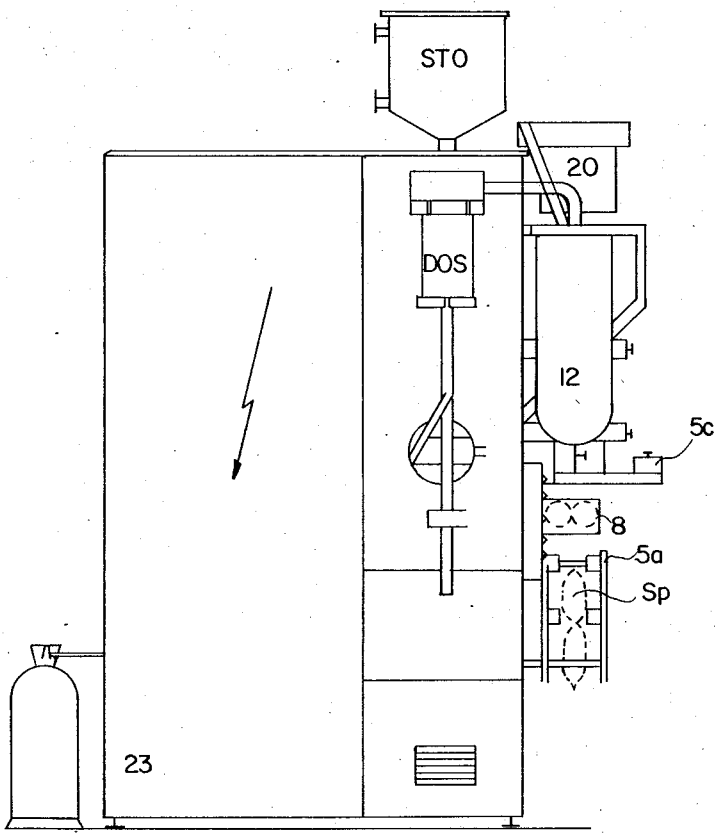

The block 5 includes the apparatus for forming the valves on the bags and the means for the simultaneous filling of the bags. These subphases, included in block 5, are: 5*b* the valve application 5*a* the first welding, , 5*c* the film stamping with incision of the validity number, 5*d* the second welding made in a transverse direction with respect to the former one, 5*e* the final cutting into individual bags. Step 5*b*, involving the valve application, as seen in FIGS. 2, 3, and 5, occurs before step 5*a* which involves the first welding operation. Furthermore, as shown in FIGS. 2, 3, and 5, the valves are applied on the longitudinal edge of the folded web in a manner which assures that the valve installing operation does not puncture both sections of the folded web. Preferably, between the subphases 5*c* and 5*d*, a subphase 5*r* is carried out. In this phase, the bags are filled by the introduction of solution S into them from the storage STO by means of the dosing pump DOS. When the filling of the dosed liquid is over, a little nitrogen volume from the source $N_2$ which passes through the filter $F_1'$ is introduced into the upper head of the bag. When more reels or a reel having a width B'' are used, a parallel filling phase SR' is carried out by a series of parallel nozzles I.

The phase 6 includes a subphase 6*a* which involves collecting the filled and separated bags SPT that come out vertically oriented at station or step 5*e*, e.g. on a conveyor NT and a test subphase 6*b*. FIGS. 2 and 3 show the test member, represented by a pressure roller pair RP suitable for carrying out an "integrity test".

The last packing phase 7 includes preferably a subphase 7*a* that applies an "outer wrapping" envelope and/or a phase 7*a'* which involves at least partial stiffening of the bag by means of a band. A subphase 7*b* involves depositing the single bags on a support or megablister, a pluraltiy of which can be arranged into layer packages or stacked for storage purposes.

It should be noted that, when the process of the invention is executed using reels having the width of n times the width of a single bag, the machine will be provided with n fixing devices for the valves (5*b*)n and (5R')n filling needles and further with n dosing devices (DOS)n and further with a phase or substation 6' in which the final cutting of the bags designated $S_1$ to $S_n$ and which are simultaneously provided from the test station 6*b* is carried out. This final cutting of the bags can be made longitudinally along the line L, L' and L'', or transversally along the line T.

Under the first option of using the longitudinal cut, there are advantages in feeding the bags to the sterilization unit (not represented as it is downstream 6*b*), as the bags which are longitudinally aligned can pass directly and continuously through the sterilization unit.

In the second case, that uses the transversal cut, some advantages are present in the automation of the movements generated in the following work phases (e.g. three bags at a time in rigid support, whereby it has a substantially rigid body having the box shape).

FIG. 2 shows at 7' the packaged and transversally cut bag group, each bag being already enclosed in its outer envelope with our without vacuum application.

FIG. 2A shows the film F coming from at least one reel B, that undergoes the print phase 2*a* before passing into the winding unit 2*b*; this substation of print is represented only in a schematic way. Among the more important advantages of the above described system according to the present invention, are double washing phase 3*a* (ultrasound) followed by 3*b* (water washing), and, more importantly, the coordination of all phases which produces very high and simultaneous production rates, which is achieved while product quality is maintained at high standards.

A particularly advantageous practical embodiment of a machine for carrying out the process according to FIGS. 1 to 2 is represented in FIGS. 4 to 7 in which STO is the solution tank; DOS is the relevant dosing pump; Fi are the filters of the filling solution; B is the film feeding reel; 2*b* is the winding unit; 3 is the washing tank divided in two sections 3*a* (ultrasound US) and 3*b* (water), 4 is the winding, alignment and sterilization unit in which the part 4*d* with the ultraviolet lamp ULV and further the folding prism PR (4*e*) can be clearly seen; 5*a* shows the longitudinal welder; 8 shows the film transport roller pair adjacent the welding unit; SP shows the transversally welded bags; 5*c* is the printing device; PH shows a photocell for controlling the stamping apparatus 5*b*; 5*d* shows the universal welder; 21 the ultrasound welder for the closing of the film; 20 shows the "closurer vibrating hopper"; TR shows the filling tube; $N_2$ shows the nitrogen tank and 26 $N_2$ the relevant injection head; 23 is the electric cab; 22 is the relevant panel with instruments and pilot lamps; 13 shows the box with hydraulic controls; 17 is the tensioning arm; and 18 is the small adjustment arm for the horizontal displacement.

To aid understanding of the present invention, the invention was described with reference to preferred embodiments thereof as represented in the drawings. But the invention is not to be limited to these embodiments as it is susceptible of many changes, modifications and substitutions that may be apparent to the skilled person. Therefore, the present invention is to be limited not by the embodiment disclosed herein, but rather by the appended claims.

We claim:

1. A method for the continuous production of flexible bags of synthetic or artificial materials and for simultaneously filling the bags with a selected fluid during the manufacture thereof, said method including the steps of:

unwinding film from a reel, the reel having a width which is an integer number multiple of the width dimension associated with said bags;

cleaning said film in two stages which include a first stage of subjecting the film to ultrasound radiation followed by a second stage of washing said film with water supplied from water jets;

drying the film;

sterilizing the film by means of ultraviolet rays;

aligning the film to permit precise folding thereof;

transporting the film along a predetermined direction;

folding the film over itself along a center fold which extends along the length direction of the film to thereby generate a front and back film section which are aligned over each other, the folding step being carried out while, simultaneously, the direction at which said film travels is changed with respect to said predetermined direction;

installing valves comprising a rubber piece enclosed within an envelope formed of the same material as said film at spaced longitudinal intervals along one of the longitudinal edges of the film which has been folded, said valves being applied onto the outer wall of the folded film without puncturing the inner wall;

welding the longitudinal ends of the folded film to one another to define an enclosed interior between the two film sections;

filling said interior of the film with said fluid;

welding the front and back sections of the film to each other along transverse seams which are located at spaced longitudinal intervals of the film;

cutting the film into a plurality of individual bags having a final shape and size; and testing the integrity of said plurality of bags.

2. The method of claim 1 in which said stiffening step includes the step of at least partially stiffening one of the faces associated with each one of said bags.

3. The method of claim 1 in which said stiffening step includes the steps of vacuum packaging the bags in a respective outer envelope.

4. The method of claim 1 further comprising the step of simultaneously producing a plurality of said bags by employing n valve feeders, n liquid batches, n filling nozzles which are disposed parallel to one another and which are operable to simultaneously apply said valves to said film and to simultaneously fill said film with said fluid, said n being an integer.

5. The method of claim 3 in which said outer envelopes are further provided with a blister-type support structure.

6. The method of claim 1 further comprising the steps of unwinding said film from said reel under controlled tension, carrying out a printing operation on said film as it unwinds from said reel and before it is subjected to said cleaning step and passing said film over dancing rollers prior to said cleaning step.

7. The method of claim 6 in which said water for washing said film is distilled water and further comprising the step of recycling and continuously distilling said distilled water.

8. The method of claim 7 in which said film is passed over dancing rollers which act as shock absorbers after said drying step and further comprising the step of stamping said film after said longitudinal weld is applied thereto.

9. An apparatus for the continuous production of flexible bags from a bag forming film comprised of synthetic or artificial materials and for the simultaneous filling of said bags with fluid during the manufacture thereof, said apparatus comprising:

a feeding unit having an unwinding unit which is adapted to support said film and having a width dimension which is an integer multiple n of the width associated with said bags and including a braking device for controlling the tension of said film as it unwinds from said unwinding unit;

a washing unit having at least one ultrasonic washing tank for cleaning said film with ultrasonic radiation and at least one washing tank with water nozzles for washing said film with water, said water nozzles being supplied with water from a closed circuit system that uses distilled water and which includes means for at least partially recycling said distilled water;

means for aligning the film for the purpose of permitting precise folding of said film over itself;

a folding prism adapted to permit said film to be folded over itself along the longitudinal dimension thereof, said film being folded to have front and back sections and an interior located between said front and back sections;

means for installing valves comprising a rubber piece enclosed within an envelope formed of the same material as said film at spaced longitudinal intervals along one of the longitudinal edges of the film which has been folded, said valves being applied onto the outer wall of the folded film without puncturing the inner wall;

means for forming longitudinal and transversal welding seams on said film to connect said front and back sections to one another to form a plurality of said bags from said film;

a double filling pipe for feeding said fluid into said bags;

means for replacing the air which is left in each said bag after said bag is filled with said liquid with inert gas and for thereafter enclosing said bag; and testing means for testing the package integrity of each said bag, said means including a band that moves in synchronism with main transport rollers and which is adapted to apply an adjustable pressure on the bags as they pass by.

* * * * *